US009565932B2

(12) United States Patent
Hirsch

(10) Patent No.: US 9,565,932 B2
(45) Date of Patent: Feb. 14, 2017

(54) PORTABLE GARMENT HANGING SYSTEM FOR A PORTABLE WARDROBE BAG

(71) Applicant: James F. Hirsch, Algonquin, IL (US)

(72) Inventor: James F. Hirsch, Algonquin, IL (US)

(73) Assignee: LifeSafety Power, Inc., Mundelein, IL (US)

( * ) Notice: Subject to any disclaimer, the term of this patent is extended or adjusted under 35 U.S.C. 154(b) by 804 days.

(21) Appl. No.: 13/831,960

(22) Filed: Mar. 15, 2013

(65) Prior Publication Data

US 2014/0262659 A1 Sep. 18, 2014

(51) Int. Cl.

| | |
|---|---|
| ***A47C 13/00*** | (2006.01) |
| ***A47B 61/06*** | (2006.01) |
| ***A47G 25/06*** | (2006.01) |
| *A45C 9/00* | (2006.01) |

(52) U.S. Cl.

CPC ..... *A47B 61/06* (2013.01); *A47G 25/0664* (2013.01); *A47G 25/0685* (2013.01); *A45C 9/00* (2013.01)

(58) Field of Classification Search

CPC ..... A47B 61/06; A45C 13/03; A45C 5/00; A45C 5/04; A45C 5/065

USPC .... 190/1, 13 R, 15 R; 312/199, 290, 6, 259; 211/118, 85.3, 206; D6/411

See application file for complete search history.

(56) References Cited

U.S. PATENT DOCUMENTS

| | | | | |
|---|---|---|---|---|
| 4,054,209 | A | 10/1977 | Solomon | |
| 4,267,905 | A | 5/1981 | Stewart | |
| 4,424,905 | A | 1/1984 | Keen | |
| D294,895 | S | 3/1988 | Valento | |
| D327,379 | S | 6/1992 | Driscoll | |
| 5,295,565 | A | 3/1994 | Latshaw | |
| 5,379,870 | A | 1/1995 | Sadow | |
| 5,617,962 | A * | 4/1997 | Chen | A47G 25/0664 211/204 |
| D414,907 | S | 10/1999 | Stelmarski | |
| 6,044,990 | A * | 4/2000 | Palmeri | A47B 47/0016 211/182 |
| 6,129,254 | A | 10/2000 | Yu | |
| D469,975 | S | 2/2003 | Sparkowski | |
| 6,644,484 | B1 * | 11/2003 | Sardis | A47B 43/00 211/189 |
| 6,910,593 | B1 | 6/2005 | Moore | |
| 7,416,066 | B2 | 8/2008 | Chernoff | |

(Continued)

*Primary Examiner* — Anthony Stashick
*Assistant Examiner* — Cynthia Collado
(74) *Attorney, Agent, or Firm* — Cygan Law Offices P.C.; Joseph T. Cygan

(57) ABSTRACT

A very light weight portable garment rack includes a first hanging rod segment and a second hanging rod segment, insertable into the first hanging rod segment, to assemble a garment hanging rod. Both the first and second hanging rod segments have perpendicular stub segments. First and second stanchions have upper insertable segments for insertion into the perpendicular stub segments to support the garment hanging rod, and lower insertable segments. A bottom support frame has two stanchion mounting segments, each fitted to the receive the lower insertable segments of the respective first and second stanchions. The first and second stanchions each have an upper support member having the upper insertable segment and an upper support member lower insertable segment, and a lower support member having the lower insertable segment and fitted to receive the upper support member lower insertable segment to assemble the respective stanchion.

13 Claims, 7 Drawing Sheets

(56) References Cited

U.S. PATENT DOCUMENTS

| | | | | |
|---|---|---|---|---|
| 7,832,574 | B1 | 11/2010 | Sexton | |
| 8,231,185 | B1 * | 7/2012 | Trusty | B65D 15/22 312/108 |
| 2007/0089952 | A1 | 4/2007 | Herbst et al. | |
| 2007/0256994 | A1 * | 11/2007 | Jackson | A45C 9/00 211/85.3 |
| 2007/0295570 | A1 * | 12/2007 | Campbell | A45C 5/14 190/15 R |
| 2009/0000894 | A1 | 1/2009 | Middup | |
| 2009/0001033 | A1 * | 1/2009 | Sung | A47B 61/06 211/85.3 |
| 2009/0321204 | A1 * | 12/2009 | Barkow | A45C 13/02 190/8 |
| 2011/0120826 | A1 | 5/2011 | Middup | |
| 2012/0007343 | A1 * | 1/2012 | Webster | B62B 3/008 280/659 |
| 2012/0097628 | A1 * | 4/2012 | Blacknell | A47B 45/00 211/85.3 |

* cited by examiner

PORTABLE GARMENT HANGING SYSTEM FOR A PORTABLE WARDROBE BAG

FIELD OF THE DISCLOSURE

The present disclosure relates generally to garment racks and portable wardrobe or garment bags, and more particularly to portable wardrobes and portable garment racks used for dance and other performances.

BACKGROUND

Performers such as dancers and actors carry a set of outfits for use during the performance or competition and are often required to make quick outfit changes prior to going out on stage to perform their dance routines. Dance supply companies exist that supply special dance related items such as "dance bags" that are designed to assist with transporting a dance wardrobe to the performance or competition site and to quickly set up a wardrobe for facilitating the quick outfit changes.

Some dance bags have garment accessories to hang the garments at the performance or competition site to make selection of outfits faster. However, these garment accessories are quite flimsy and do not support much weight, and easily collapse which can be a problem for competitors who are trying to move quickly to remove and replace outfits.

DETAILED DESCRIPTION

Figure 1:
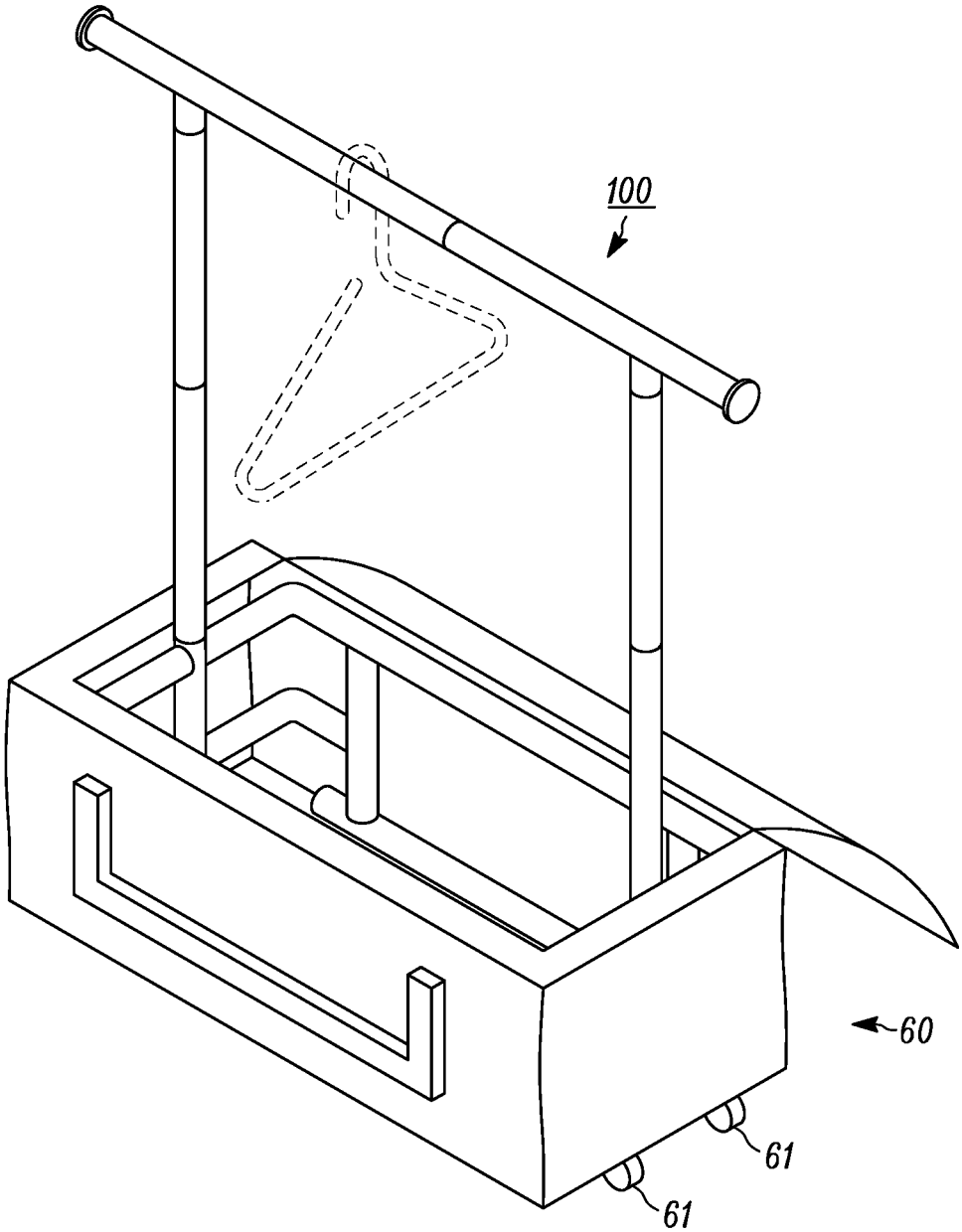
FIG. 1 is perspective view of a portable garment hanging system in accordance with an embodiment.

The present disclosure provides, among other things, a very light weight portable garment rack that has a garment hanging rod with a first hanging rod segment and a second hanging rod segment. The second hanging rod segment has an insertable segment, insertable into the first hanging rod segment to assemble the garment hanging rod. Both the first and second hanging rod segments have perpendicular stub segments. First and second stanchions have upper insertable segments for insertion into the perpendicular stub segments to support the garment hanging rod, and lower insertable segments. A bottom support frame has two stanchion mounting segments, with each fitted to the receive the lower insertable segments of the respective first and second stanchions to support the first and second stanchions and the garment hanging rod.

The first and second stanchions may further each have an upper support member having the upper insertable segment and an upper support member lower insertable segment, and a lower support member having the lower insertable segment and fitted to receive the upper support member lower insertable segment to assemble the respective stanchion.

The bottom support frame may include two horizontal upper frame members, each coplanar and connected to the two stanchion mounting segments. In one embodiment, the bottom support frame has two parallel footing segments, coplanar, positioned below the two horizontal upper frame members.

The bottom support frame of the embodiment may also have four vertical frame members, with two vertical frame members connected to one of the two parallel footing segments and to one of the two horizontal upper frame members, and with another two vertical frame members connected to the other of the two parallel footing segments and to the other of the two horizontal upper frame members.

In some embodiments, the bottom support frame may have four horizontal lower frame members, positioned coplanar below the two horizontal upper frame members and above the two parallel footing segments, with two of the horizontal lower frame members each connected to one of the two stanchion mounting segments, and the other two of the horizontal lower frame members each connected to the other one of the two stanchion mounting segments. Each of the four horizontal lower frame members may be connected to a respective one of the four vertical frame members.

In some embodiments, the first hanging rod segment, the second hanging rod segment, the upper support members and lower support members of the first and second stanchions, may be formed from aluminum tubing or a carbon fiber material. The two parallel footing segments, the four vertical frame members, and the four horizontal lower frame members may also be formed from aluminum tubing or a carbon fiber material. In other words, in some embodiments, the portable garment rack may be partly formed from aluminum tubing and partly formed from carbon fiber material, or entirely formed from either material of from a plastic material.

In one embodiment, the aluminum tubing has at least a one inch outer diameter. In some embodiments, the first hanging rod segment, the second hanging rod segment, the upper support members and lower support members of the first and second stanchions, may be formed from aluminum tubing with at least a one inch outer diameter. Also, the two parallel footing segments, the four vertical frame members, and the four horizontal lower frame members may be formed from aluminum tubing with at least a ¾ inch other diameter. The two stanchion mounting segments may also be formed from aluminum tubing having the same outer diameter as the at least one inch outer diameter.

In one embodiment, the bottom support frame may have two symmetrical footing members positioned below the two horizontal upper frame members, with each footing member having a primary longitudinal horizontal segment with two upwardly sloped segments at each end, and two upper inward transverse horizontal segments connected at upper ends of the respective upwardly sloped segments having a connection to a respective one of the two stanchion mounting segments.

In another embodiment, the bottom support frame may have two symmetrical footing members positioned below the two horizontal upper frame members, with each footing member having two longitudinal horizontal segments, two upwardly sloped segments and an upper transverse horizontal segment connecting the upper ends of the upwardly sloped segments, each upper transverse horizontal segment connected to a respective one of the two stanchion mounting segments.

The present disclosure also provides a portable garment hanging system that includes the portable garment rack, and a portable wardrobe bag that has a main inner compartment. The bottom support frame fits within the main inner compartment, and the garment hanging rod and first and second stanchions fit within the main inner compartment for storage when dissembled. The bottom support frame also provides clearance for a wheel assembly that protrudes into the main inner compartment. The bottom support frame may be formed from aluminum tubing or a carbon fiber material of from a plastic material in some embodiments.

Turning now to the drawings wherein like numerals represent like components, FIG. 1 is perspective view of a portable garment hanging system in accordance with an embodiment. The portable garment hanging system includes a portable garment rack 100 and a portable wardrobe bag 60 which may be a duffel bag and, more particularly, may be a wheeled duffel bag that has internal wheel assemblies that may interfere with the position of the portable garment rack 100. The portable garment rack 100 is designed such that a bottom support frame provides clearance so as to not interfere with the internal wheel assemblies of the portable wardrobe bag 60. Additionally, the design of the bottom support frame provides clearance so as to not interfere with the extendable handles used to pull the portable wardrobe bag. Details of the portable garment rack 100 are provided in the perspective view assembly diagram of FIG. 2 and front elevation view of the assembled portable garment rack shown in FIG. 3.

Figure 4A:
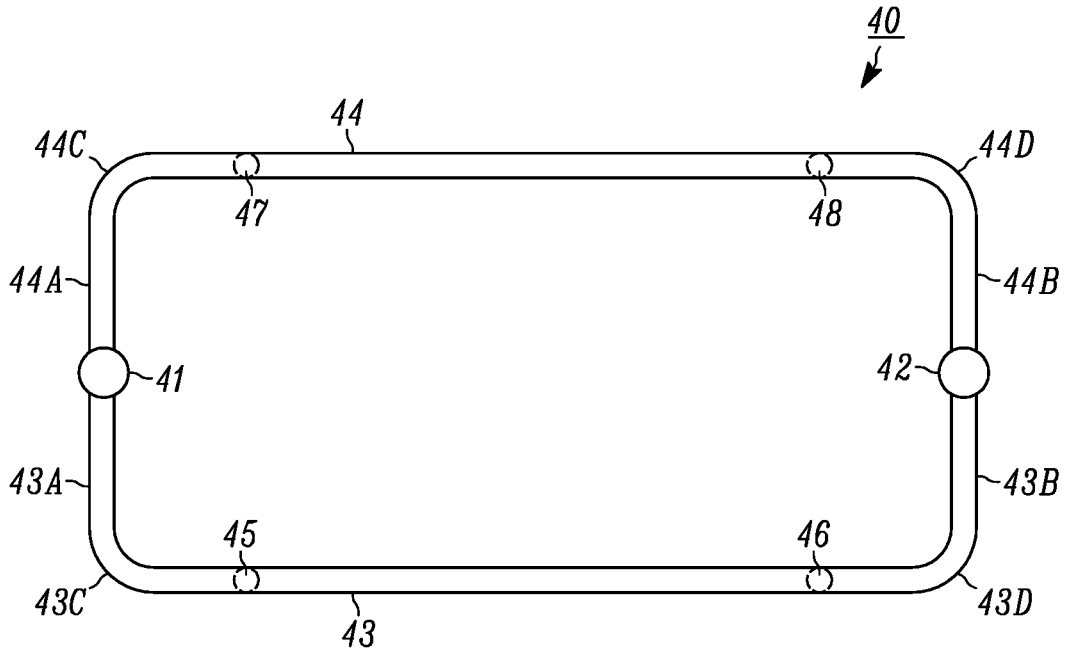
FIGS. 4A and 4B are a top view and front elevation view, respectively, of the bottom frame of the portable garment rack shown in FIG. 1, FIG. 2 and FIG. 3, in accordance with one embodiment.
Figure 4B:
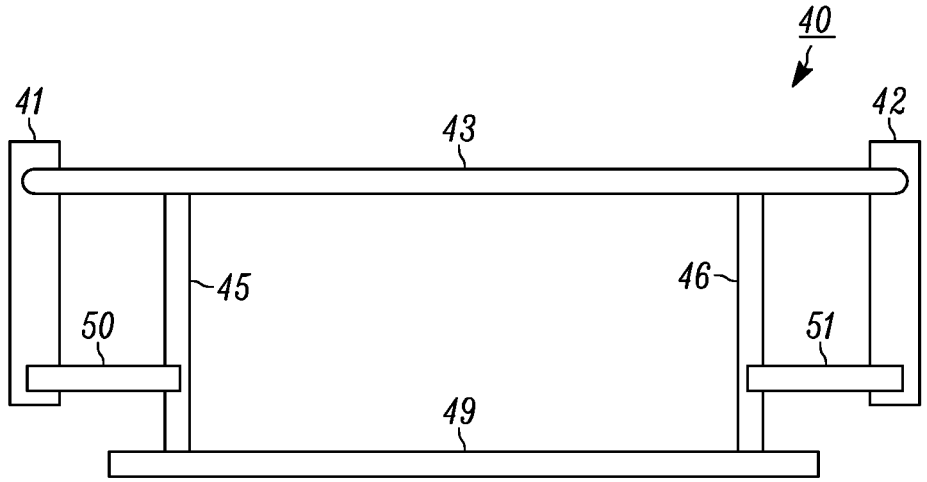

The portable garment rack 100 may be used separate from the portal wardrobe bag 60 if desired by removing the bottom support frame 40 and placing it on the floor. Two parallel symmetric footing segments 49 are positioned horizontally, spaced apart a distance to prevent the portable garment rack 100 from tipping in any direction. The bottom support frame 40 is one type of bottom support frame in accordance with an embodiment. Further details of the bottom support frame 40 are illustrated in FIG. 4A and FIG. 4B. The portable garment rack 100 includes two stanchions that extend from the support frame 42 to support a hanging rod for hanging clothes hangers when the portable garment rack 100 is assembled.

The two stanchions each consist of an identical upper support member 20, 21 and an identical lower support member 30, 31. The lower support members 30, 31 each consist of a primary segment 32 and a lower insertable segment 33. The lower insertable segment 33 of the two lower support members 30, 31 each inserts into a first and second stanchion mounting segment 41, 42 of the bottom support frame 40.

The two identical upper support members 20, 21 consist of a primary segment 22, an upper insertable segment 23 and a lower insertable segment 24. The lower insertable segment 24 inserts into the primary segment 32 of each of the lower support members 30, 31.

The hanging rod consists of a first hanging rod segment 10 and a second hanging rod segment 11. The first hanging rod segment 10 consists of a primary segment 14 having a perpendicular stub segment 13 positioned substantially toward one end of the primary segment 14. An end cap 12 may be placed at the end of the primary segment 14 near the perpendicular stub segment 13 extending therefrom. The second hanging rod segment 11 likewise has a primary segment 15 and a perpendicular stub segment 16 substantially toward one end of the primary segment 15. The primary segment 15 may also have an identical end cap 12 at the end of the primary segment 15, near the perpendicular stub segment 16 position. The second hanging rod segment 11 also has an insertable segment 17, that is insertable into the primary segment 14 to form the complete hanging rod. The purpose of a two piece or telescopic hanging rod segment is to provide a hanging rod with a length greater than the length of the bag. That is, the hanging rod may be a telescopic hanging rod assembly in some embodiments. The upper insertable segment 23 of each of the upper support members 20, 21 are insertable into the perpendicular stout segments 13 and 16 to support the hanging rod at the top of the stanchions.

The various insertable segments of the various components of the portable garment rack 100 described above may be formed in a variety of ways in accordance with the embodiments. In one example, the insertable segments are a tubing segment having a smaller outer diameter than the inner diameter of the respective mating segment. In other embodiments, the insertable segments may be formed by crimping or by compression depending on the material used to form the support members and the hanging rod segments. In one example embodiment, the upper support members 20, 21 and the lower support members 30, 31 are formed from aluminum tubing. In such embodiments, the insertable segments may be formed by crimping the aluminum tubing ends to create the insertable smaller diameter segments. Alternatively, the upper support members and lower support members may form single telescoping stanchion units that may be opened during assembly and telescopically shortened for storage and transport.

The bottom support frame 40 is best understood with respect to FIGS. 4A and 4B which are a top view and front elevation view, respectively, of the bottom frame 40 of the portable garment rack 100 in accordance with one embodiment. The bottom support frame 40 consists of two horizontal upper frame members connected to the first and second stanchions mounting segments 41, 42 to form substantially a rectangle as viewed from the top. The rectangle length and width is commensurate with the inner length and width of the portable wardrobe bag 60. Either of the first and second stanchion mounting segments 41, 42 may be used to support a clothes hanger. That is, the hook of a clothes hanger may be hooked about one of the first and second stanchion mounting segments 41, 42, to maintain clothing in position within the portable wardrobe bag 60 as the portable wardrobe bag 60 is transported. Furthermore, the clothing is maintained in a hanging position when the portable wardrobe bag 60 is positioned vertically and stood on end, provided that the hangers are hooked to the stanchion mounting segment positioned at the "top" end of the portable wardrobe bag 60 with respect to its vertical, and rollable, position.

The two horizontal upper frame members are identical and are best understood with respect to the top view of FIG. 4A. One horizontal upper frame member includes a primary longitudinal horizontal segment 43. The primary longitudinal horizontal segment 43 has two ends, each of which is connected to two inward transverse horizontal segments 43A and 43B at two corresponding right angle connection points 43C and 43D, respectively. The two inward transverse horizontal segments 43A, 43B are coplanar with the primary longitudinal horizontal segment 43 and together form one horizontal upper frame member which is substantially half of a rectangle when viewed from the top as in FIG. 4B.

Figure 2:
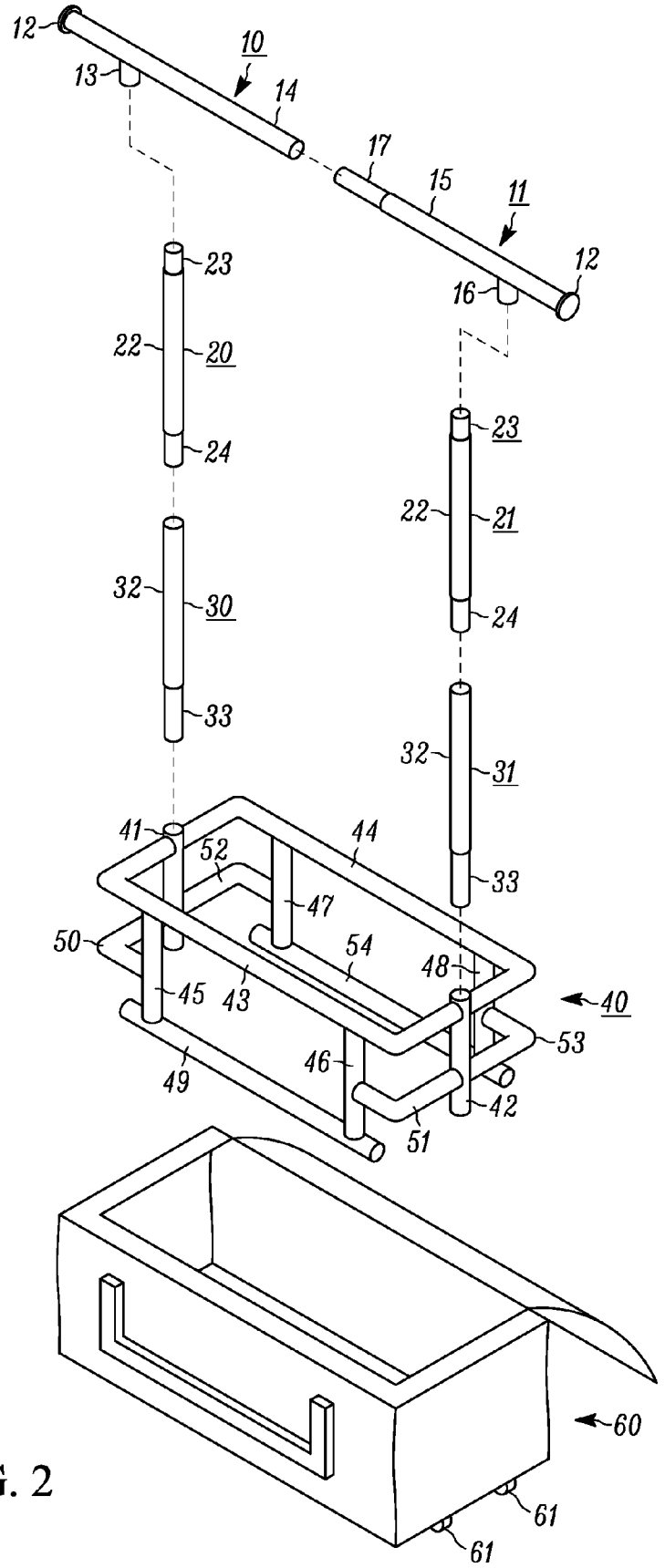
FIG. 2 is a perspective view assembly diagram of the portable garment hanging system of FIG. 1, in accordance with an embodiment.

The two inward transverse horizontal segments 43A, 43B are connected to the first stanchion mounting segment 41 and the second stanchion mounting segment 42, respectively. An identical, oppositely positioned, coplanar horizontal upper frame member is also connected to the first stanchion mounting segment 41 and second stanchion mounting segment 42 at the same height. That is, the primary longitudinal horizontal segment 44 is positioned in the same plane, that is, coplanar, with the primary longitudinal horizontal segment 43 to form the other lengthwise side of a substantial rectangle. The primary longitudinal horizontal segment 44 is likewise connected to an inward transverse horizontal segment 44A at one end at a right angle connection point 44C, and at the other end is connected to an inward transverse horizontal segment 44B at right angle connection point 44D. The other ends of the inward transverse horizontal segments 44A and 44B are accordingly connected to the first stanchion mounting segment 41 and the second stanchion mounting segment 42, respectively. Additionally, each one of the horizontal upper frame members is supported by two vertical frame member pairs 45 and 46, and 47 and 48, respectively. As shown in the front elevation view of FIG. 4B, a footing segment 49 is connected to the bottom ends of the vertical frame members 45 and 46. The opposite footing member 54, which is visible only in FIG. 1 (inside the portable wardrobe bag 60) and FIG. 2, is coplanar and is in parallel with the footing segment 49. The footing segment 54 is connected to the primary longitudinal horizontal segment 44 of the horizontal upper frame member by the pair of vertical frame members 47 and 48. The vertical frame members are connected to the primary longitudinal horizontal segments 43 and 44 near the respective right angle connection points 43C and 43D, and 44C and 44D. The respective vertical frame member pairs form right angles with the two primary longitudinal horizontal segments 43 and 44, and with the footing segments 49 and 54.

Further support for the stanchions is provided by a set of horizontal lower frame members 50, 51, 52 and 53. Each of the first and second stanchion mounting segments 41 and 42 are connected to a pair of the vertical frame members using a pair of the horizontal lower frame members. Specifically, first stanchion mounting segment 41 is connected to the vertical frame member 45 by horizontal lower frame member 50, and is connected to vertical frame member 47 by horizontal lower frame member 52. Similarly, second stanchion mounting segment 42 is connected to vertical frame member 46 by horizontal lower frame member 51, and is connected to vertical frame member 48 by horizontal lower frame member 53. The vertical frame members are connected to their respective stanchion mounting segments at points below the connections of the horizontal upper frame members to the stanchion mounting segments. The horizontal lower frame members 50, 51, 52 and 53 are vertically spatially separated from the horizontal upper frame members to provide structural support for stanchions.

Each of the horizontal lower frame members is positioned horizontally (i.e. in a horizontal plane) coplanar to one another and are in parallel with two segments of the horizontal upper frame members. Each horizontal lower frame member 50, 51, 52, 53 consists of a long segment and a short segment connected at a right angle connection point. The ends of the long segments of the horizontal lower frame members 50, 52 are connected at opposite points, to the stanchion mounting segment 41. The ends of the short segments of the horizontal lower frame members 50, 52 are connected to the vertical frame members 45 and 47, respectively. The ends of the long segments of the horizontal lower frame members 51, 53 are connected at opposite points, to the stanchion mounting segment 42. The ends of the short segments of the horizontal lower frame members 51, 53 are connected to the vertical frame members 46 and 48, respectively.

The horizontal lower frame member 50 has a long segment below, and in parallel with, the inward transverse horizontal segment 43A and a short segment below, and in parallel with, the primary longitudinal horizontal segment 43. The horizontal lower frame member 51 has a long segment below, and in parallel with, the inward transverse horizontal segment 43B and a short segment below, and in parallel with, the primary longitudinal horizontal segment 43.

The horizontal lower frame member 52 has a long segment below, and in parallel with, the inward transverse horizontal segment 44A and a short segment below, and in parallel with, the primary longitudinal horizontal segment 44. The horizontal lower frame member 53 has a long segment below, and in parallel with, the inward transverse horizontal segment 44B and a short segment below, and in parallel with, the primary longitudinal horizontal segment 44.

The footing segment 49 is positioned below, and in parallel with, the short segments of horizontal lower frame members 50 and 51, while the footing segment 54 is positioned below, and in parallel with, the short segments of horizontal lower frame members 52 and 53. The length of the footing segments, 49, 54, and the height of the horizontal plane in which the horizontal lower frame member 50, 51, 52, 53 are positioned, provides clearance for a part of a wheel assembly 61 that protrudes into the main inner compartment of the portable wardrobe bag 60 as well as the extendable handle of the portable wardrobe bag 60. That is, when the bottom support frame 40 is placed within the portable wardrobe bag 60 as shown if FIG. 1, the footing segments 49, 54 lay flatly such that the entire portable garment rack 100 may stand firmly on the floor inside the bottom of the bag. That is, the entire portable garment hanging system including the assembled portable garment rack 100 and portable wardrobe bag 60 may stand on the floor as shown in FIG. 1 such that garments may be removed from the main inner compartment of the portable wardrobe bag 60 and hung from the garment hanging rod for access and usage.

The bottom support frame 40 provides an advantage of giving rigidity to the portable wardrobe bag 60 in embodiments where the portable wardrobe bag 60 is made from canvas, vinyl or some other suitable flexible material. The added rigidity prevents delicate items and delicate outfits from being crushed or damaged in case the bag is stacked or compressed during transport. The bottom support frame also provides rigidity to a flexible bag allowing it stand up on end without falling over.

Among the advantages of the various embodiments, the segments of the portable garment rack 100 that form the stanchions and the hanging rod may be easily assembled and disassembled in the field. The bottom support frame 40 may be left in place within the portable wardrobe bag 60, or may be removed if desired and stood on the floor using the footing segments 49 and 54. The portable garment rack 100 may be assembled in the field by first inserting the lower insertable segments 33 of the lower support members 31 and 32 into one of the respective stanchion mounting segments 41 and 42. The lower insertable segments 24 of the identical upper support members 20, 21 are then inserted into the lower support members 30, 31 respectively.

The insertable segment 17 of the second hanging rod segment 11 is inserted into the primary segment 14 of the first hanging rod segment 10 and may, in some embodiments, be locked into place, into a respective hole in the primary segment 14, using a spring-loaded dowel pin or a cotter pin in the insertable segment 17. The perpendicular stub segments 13 and 16 are then positioned such that the upper insertable segments 23 of respective upper support members 20, 21 are inserted into the perpendicular stub segments such that the hanging rod segment is supported by the stanchions.

The opposite procedure may be followed for disassembly and each of the segments making up the hanging rod and the stanchions may be stored within the inner portion of the bottom support frame 40 within the portable wardrobe bag 60 during transport.

The various support members may be made of various materials in the various embodiments such as, but not limited to, aluminum tubing or channel or a plastic tubing or channel. The plastic tubing or channel may be formed from a polyvinyl chloride (PVC) material or some other suitable material having rigidity suitable for supporting the garments without bending the upper or lower support members or the hanging rod segments.

The members may be tubular and have circular cross-sections in some embodiments, however the embodiments are not limited to any specific cross-section. Various channels such as c-channel, I-channel, or different cross-sections including square, triangular, octagonal, hexagonal, or other cross-sectional shapes, etc. may be used in accordance with the embodiments.

Some example dimensions will now be provided for an example embodiment. However, it is to be understood that these dimensions are examples only that are not to be construed as limiting or requirements and that, in light of the disclosure and description provide herein, such dimensions may be modified by those of ordinary skill to arrive at various other contemplated embodiments that have different dimensions, possibly for different sizes of portable wardrobe bags or for other purposes, and that such other embodiments are contemplated by the inventor in disclosing such example dimensions. That is, the example dimensions provided are approximate in that they are not only to be understood as being within some mechanical tolerance suitable for the example embodiment, but also may be modified in relation to other components by increasing or decreasing the example dimensions so as to still retain the features and functions described herein as contemplated by the disclosed embodiments.

Thus, in accordance with the above understanding, in one example embodiment that uses aluminum tubing, the upper support members 20, 21 and lower support members 30, 31 may be 1¼ inch outer diameter tubing. The bottom support frame 40 may be made from aluminum tubing having a ¾ inch outer diameter. However the stanchion mounting segments 41, 42 may be 1¼ inch outer diameter tubing, i.e. the same as used for the upper support members and lower support members.

In one embodiment the portable wardrobe bag 60 has an overall length of approximately 33 inches in width of approximately 15 inches. Therefore the bottom support frame 40 is dimensioned to have an appropriate length and width such that the bottom support frame 40 fits within the main inner compartment of the portable wardrobe bag 60. As understood by those of ordinary skill, differently sized portable wardrobe bags will have differently sized bottom support frames accordingly.

The length of the footing segments 49, 54 may be approximately 27 inches long and positioned relatively centered with respect to the bottom support frame 40 such that clearance of approximately 3 inches exists on either side of the ends of the footing segments 49, 54 to provide clearance for the internally protruding wheel assembly 61 of the portable wardrobe bag 60 and the extendable handle mechanism for pulling the bag. The bottom support frame 40 is symmetrical lengthwise such that it may be positioned either way lengthwise within the portable wardrobe bag 60 while still providing clearance for the wheel assemblies.

Figure 3:
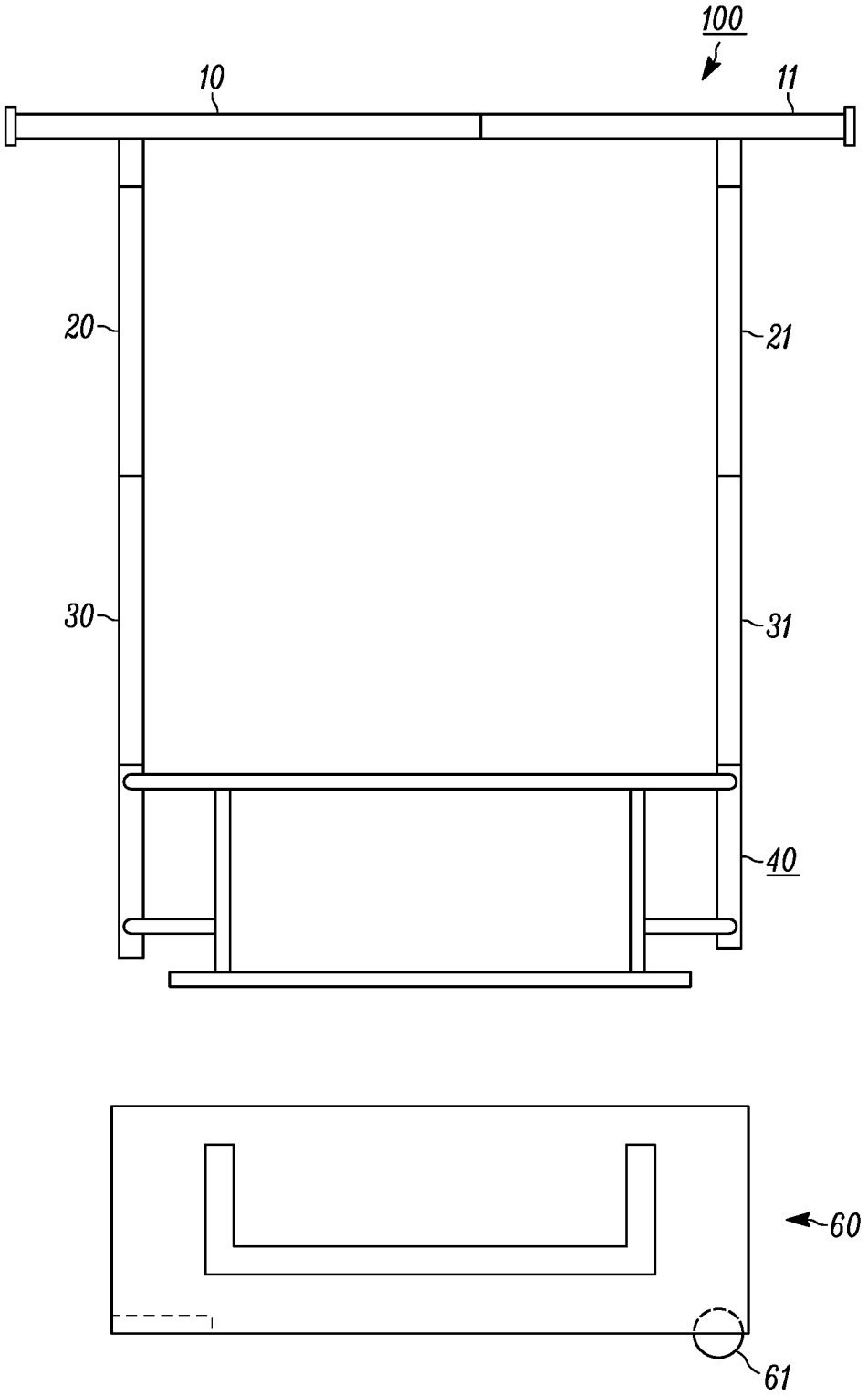
FIG. 3 is a front elevation view of the assembled portable garment hanging system with the portable garment rack removed from the wardrobe bag, in accordance with an embodiment.

Referring to FIG. 3, the portable garment rack 100 may have an overall height of 56 inches measured from the bottom of the footing segments 49, 54 to approximately the centerline of the assembled hanging rod formed by hanging rod segments 10, 11. In some embodiments, the hanging rod height could be lower where the stanchions are shortened by omitting or not using the lower support members 30, 31. That is, the lower insertable segments 24 could be inserted into the stanchion mounting segments 41, 42 to provide a shorter height garment rack. The portable garment rack 100 may have a width of approximately 44 inches as measured from the outside surfaces of the and end caps 12 across the assembled hanging rod. The stanchions may be positioned approximately 30 inches apart, or approximately 31 inches as measured from centerline to centerline of the upper support member 20 and the upper support member 21. The width measured from the inner surface of the upper support member 20 to the inner surface of the upper support member 21 may be approximately 30 inches when 1¼ inch outer diameter aluminum tubing is used. The end caps 12 may have a diameter of approximately 2 inches.

The hanging rod segment 10 may have an overall length of approximately 24⅝ inches measured from the end cap 12 outer surface to the end of the primary segment 14. The lengths of the hanging rod segment 10 and hanging rod segment 11 are designed to be identical such that the second hanging rod segment 11 likewise has an overall length of 24⅝ inches as measured from the outer surface of end cap 12 to the end of the insertable segment 17. The perpendicular stub segments 13 and 16 are each approximately 2½ inches long. The insertable segment 17 may be approximately 5 inches long in some embodiments. That is, the overall hanging rod, when assembled, has an overall length of approximately 44 inches measured from end cap 12 to end cap 12.

The identical upper support members 20, 21 may each be approximately 20 inches long. The upper insertable segments 23 may be approximately 2 inches long, while the lower insertable segments 24 may be approximately 3 inches long. The upper insertable segments 23 and the lower insertable segments 24 may have an outer diameter of approximately 1⅛ inches. The identical lower support members 30, 31 may have an overall length of approximately 20 inches with the lower insertable segments 33 being approximately 5 inches long. The lower insertable segments 33 may also have an outer diameter of approximately 1⅛ inches.

The bottom support frame 40 may have an overall height of approximately 11 inches measured from the bottom of the footing segments 49, 54 to the top surface of the horizontal upper frame members. The distance measured between the top surface of the footing segments 49, 54 and the horizontal upper frame members as measured against the bottom surface of the primary longitudinal horizontal segments 43, 44 may be approximately 9½ inches. The distance between the vertical frame member pairs 45, 46 and between vertical frame member pair 47, 48, may be approximately 20¾ inches. The stanchion mounting segments 41 and 42 may be made of a 1¼ inch outer diameter aluminum tubing, while the remaining segments forming the bottom support frame 40 may be made from ¾ inch outer diameter tubing. The stanchion mounting segments 41, 42 may have a 10 inch overall length and may be positioned such that ½ inch extends above the top surface of the horizontal upper frame members and approximately 1¼ inches extends below the bottom surface of the horizontal lower frame members 50, 51, 52 and 53.

The overall weight of the portable garment rack 100, when assembled, is extremely lightweight and may be lifted from the bottom support frame with one hand in most cases. That is the entire assembly of the portable garment rack 100 is only a few to several pounds, particularly less than 10 pounds, between 5 and 10 pounds, and may be less than 5 pounds total weight not including the portable wardrobe bag 60. That is, the weight of the portable garment rack 100 assembled, may be approximately 5 pounds total weight and is therefore extremely light weight and easy to move and transport. Despite the extremely light weight of the portable garment rack 100, it provides adequate stability based on the construction of the bottom support frame 40 and is able to support many pounds of garments hanging from the hanging rod segments 10, 11 when assembled. For example the portable garment rack 100 may support up to 50 pounds of garments distributed across the garment hanging rod. The weight of the portable garment rack 100 is determined by the material used, for example, in some embodiments, aluminum, a carbon fiber material, a plastic material, or combinations thereof. In some embodiments using aluminum tubing, the weight is determined by the outer diameter and wall thicknesses of the aluminum tubing utilized and the overall lengths of tubing utilized.

In the example embodiments described above, the insertable segments are configured such that the outer edges of the primary segments 22 lower ends are seated on the upper ends of the respective primary segments 32, etc. That is, the segment sit end to end to provide structural support. However, the various insertable segments of the various support members and of the hanging rod segments may be implemented in various ways in accordance with various embodiments. In one embodiment, the insertable segments may be formed using tubing of like material to the support members, the bottom support frame, and the hanging rod segments. In this case, segments of tubing having outer diameters approximately equal to the inner diameter of the primary segment may be press fit or welded into the primary segments to have an interference fit therewith. In embodiments where the primary segment outer diameter and wall thickness is adequate to provide strong enough insertable segments, the outer diameters may be turned down using machine tools to form the insertable segments. In yet other embodiments, the insertable segments may be formed by crimping, compressing to a smaller diameter or by forming compression dents in ends of the primary segments.

Figure 5A:
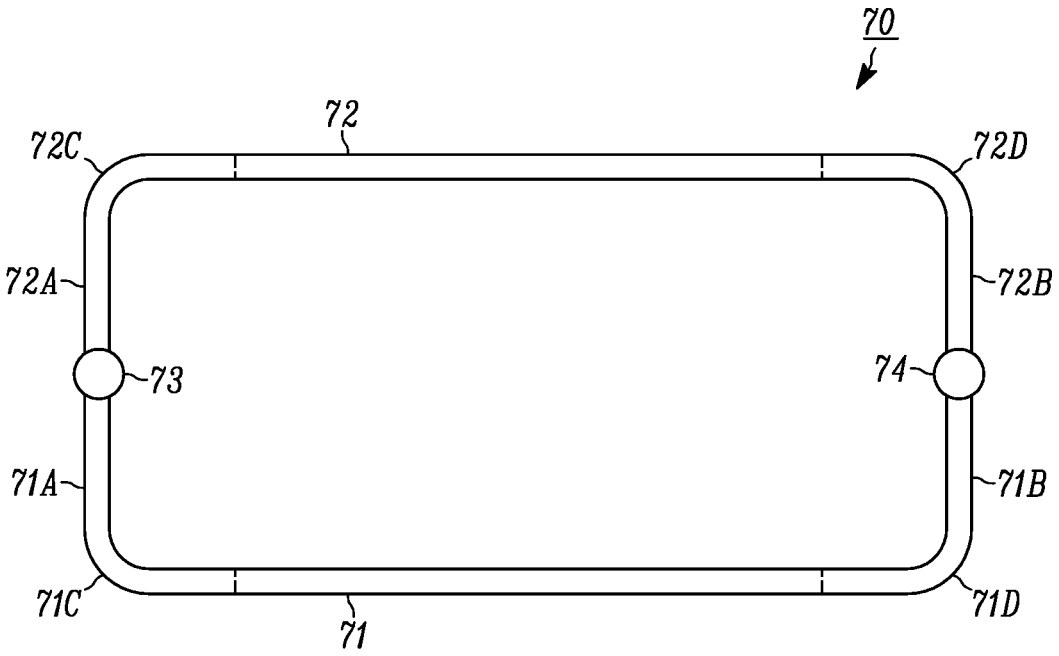
FIGS. 5A and 5B are a top view and front elevation view, respectively, of the bottom frame of a portable garment rack, in accordance with another embodiment.
Figure 5B:
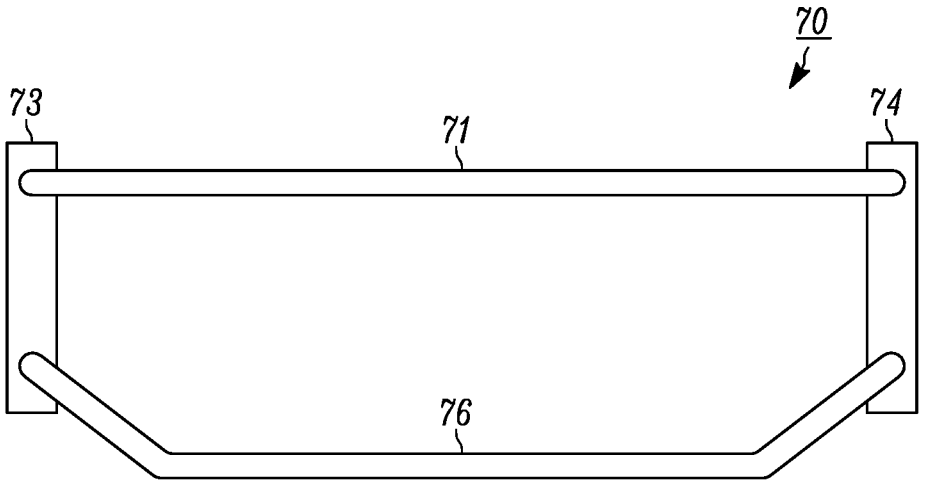
Figure 5C:
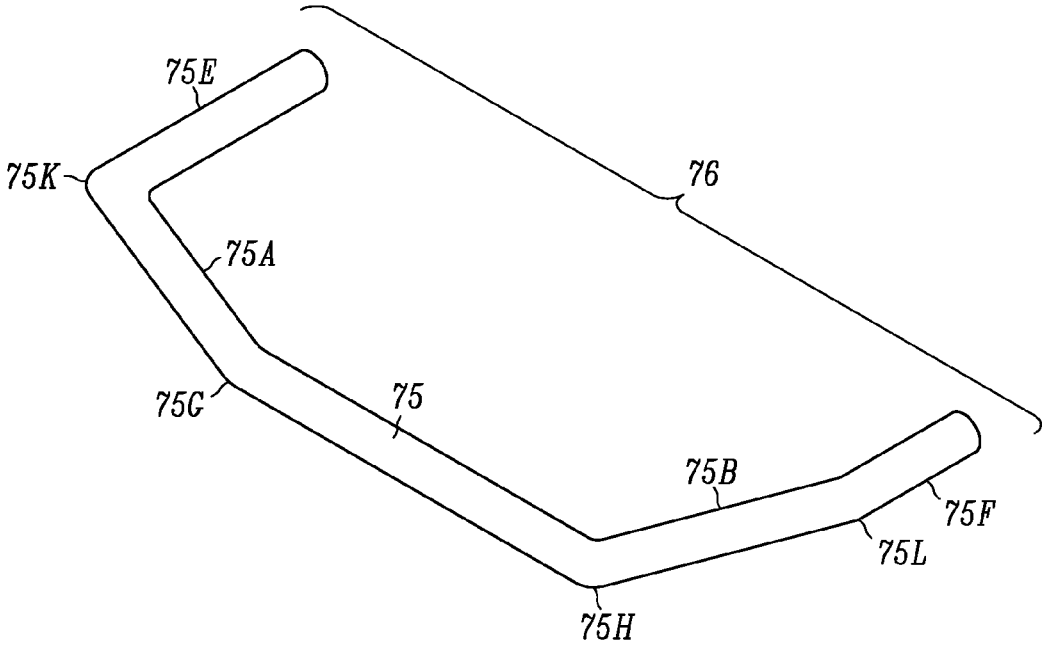
FIG. 5C is a perspective view of one half of the frame footing in accordance with the embodiments shown in FIG. 5A and FIG. 5B.

Another embodiment of a bottom support frame 70 is illustrated in FIGS. 5A, 5B and 5C. Similar to the bottom support frame 40, the bottom support frame 70 includes two horizontal upper frame members as illustrated in the top view of FIG. 5A. The two horizontal upper frame members are identical, and each consists of respective primary longitudinal horizontal segments 71, 72. The primary longitudinal horizontal segment 71 is connected at each end to inward transverse horizontal segments 71A, 71B, via respective right angle connection points 71C, 71D. The primary longitudinal horizontal segment 72 is connected at each end to inward transverse horizontal segments 72A, 72B, via respective right angle connection points 72C, 72D.

The inward transverse horizontal segments 71A, 72A are connected, at diametrically opposite points, to stanchion mounting segment 73; and the inward transverse horizontal segments 71B, 72B are connected, at diametrically opposite points, to stanchion mounting segment 74.

Unlike the bottom support frame 40, the bottom support frame 70 includes two identical footing members 76. Each of the two identical footing members 76 is connected at each end to the two stanchion mounting segments 73, 74. Further details of the footing member 76 are illustrated in the perspective view shown in FIG. 5C. The footing member 76 illustrated in FIG. 5C forms one half of the footing member assembly. Each footing member 76 includes a primary longitudinal horizontal segments 75 and two upwardly sloped segments 75A, 75B, at each end, connected by respective angled connection points 75G, 75H. The upwardly sloped segments 75A, 75B form obtuse angles with the primary horizontal segment 75. The upwardly sloped segment 75A connects, at its upper end, to an upper inward transverse horizontal segment 75E via a right angle connection 75K. Likewise, the upwardly sloped segment 75B connects, at its upper end, to an upper inward transverse horizontal segment 75F via a right angle connection 75L. Each inward end of the upper inward transverse horizontal segments 75E, 75F connect to the stanchion mounting segments 73, 74 respectively. These connections are diametrically opposite the connections to the upward inward transverse horizontal segments of the identical and opposite footing member that forms the overall footing assembly.

When the portable garment rack embodiment having the bottom support frame 70 is positioned on the floor, the primary horizontal segment 75 contacts the floor while the upwardly sloped segments 75A, 70 5B provide clearance for the internal wheel assembly 61 and the extendable handle mechanism of the portable wardrobe bag 60.

Figure 6C:
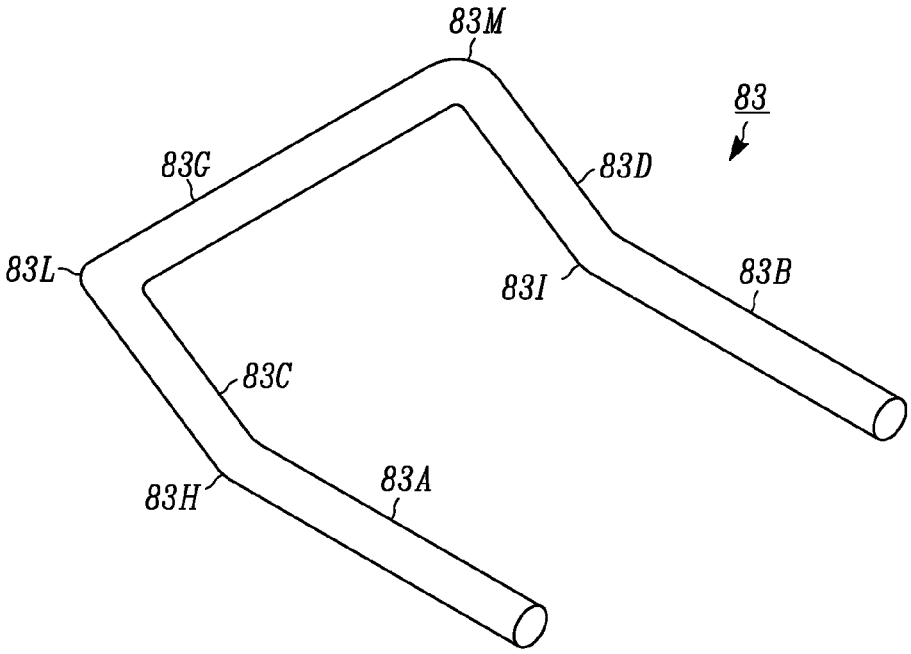
FIG. 6C is a perspective view of one half of the frame footing in accordance with the embodiments shown in FIG. 6A and FIG. 6B.
Figure 6A:
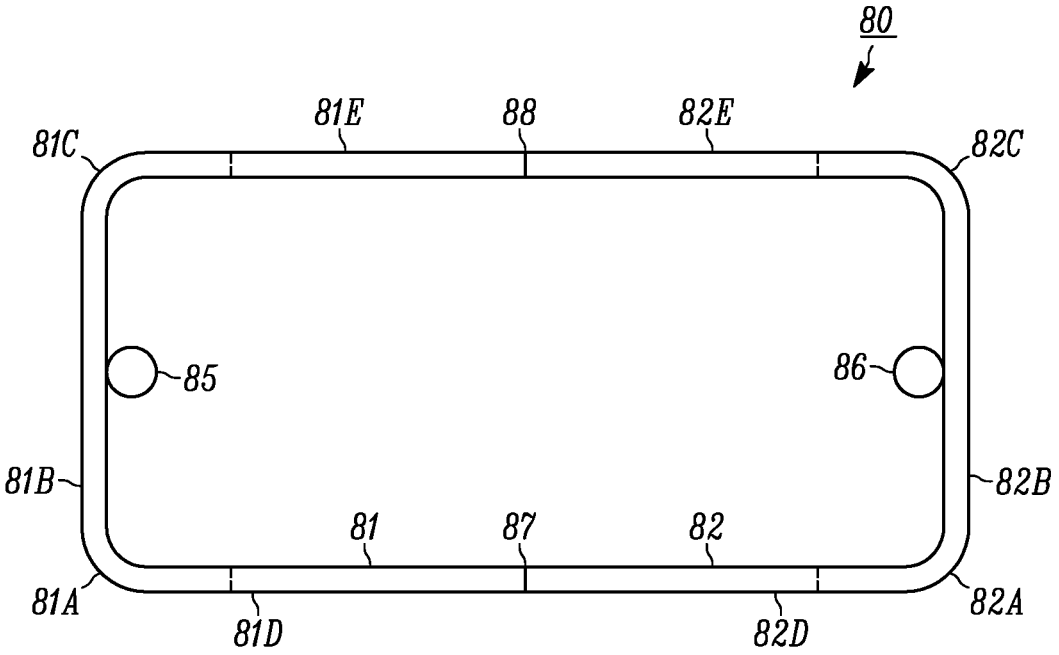
FIGS. 6A and 6B are a top view and front elevation view, respectively, of the bottom frame of a portable garment rack, in accordance with yet another embodiment.
Figure 6B:
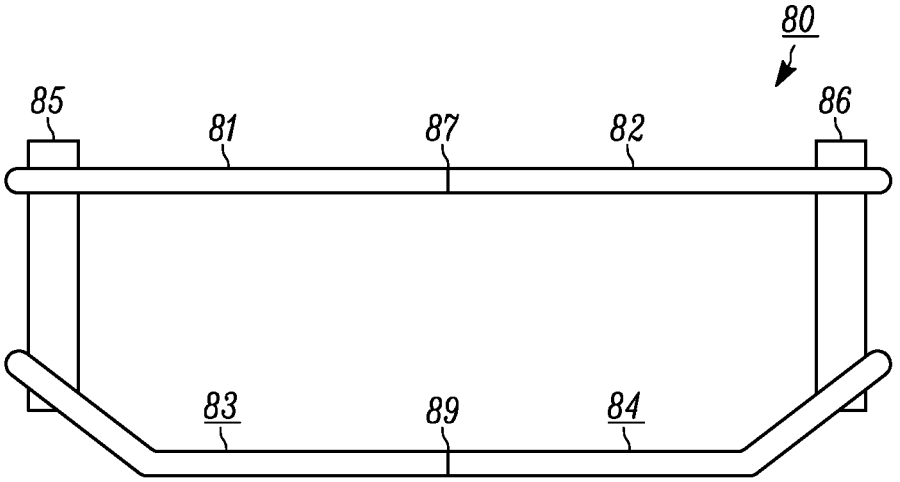

Yet another embodiment of a bottom support frame 80 is illustrated in FIG. 6. FIGS. 6A and 6B are a top view and front elevation view, respectively, of the bottom frame 80, while FIG. 6C is a perspective view of one half of the frame footing assembly in accordance with the FIG. 6 embodiment. In the embodiment illustrated in FIG. 6, two horizontal upper frame members 81, 82 are identical and are connected at connection points. 87, 88 to form a substantial rectangle about the outer surfaces of stanchion mounting segments 85, 86. As shown in FIG. 6A, horizontal upper frame member 81 consists of two longitudinal horizontal segments 81D, 81E connected to a single inward transverse horizontal segment 81B via right angle connection points 81A, 81C, respectively. The inverse transverse horizontal segment 81B is tangential to the outer circumferential surface of the stanchion mounting segment 85. Likewise the identical horizontal upper frame member 82 consists of two longitudinal horizontal segments 82D, 82E connected to a single inward transverse horizontal segment 82B via right angle connection points 82A, 82C, respectively. The inverse transverse horizontal segment 82B is tangential to the outer circumferential surface of the stanchion mounting segment 86.

A footing assembly consisting of two identical footing members 83, 84 are also connected tangential to the outer circumferential surface of the stanchion mounting segments 85, 86 and are positioned beneath the respective horizontal upper frame members 81, 82, respectively. Further details of the footing members 83, 84 are illustrated in the perspective view of FIG. 6C. In FIG. 6C, only footing member 83 is illustrated, however footing member 84 is symmetrical and identical to footing member 83.

Thus, footing member 83 consists of two longitudinal horizontal segments 83A, 83B, each connected to a respective upwardly sloped segment 83C, 83D, via respective angled connection points 83H, 83I. The upwardly sloped segments 83C, 83D, form obtuse angles with the respective longitudinal horizontal segments 83A, 83B. Each of the upwardly sloped segments 83C, 83D are connected, at their upper ends, to an upper transverse horizontal segment 83G by respective right angle connection points 83L, 83M. The upper transverse horizontal segment 83G is connected to the stanchion mounting segment 85 and is tangential to the outer circumferential surface of the stanchion mounting segment 85. An identical upward transverse horizontal segment of the footing member 84 likewise is connected to the stanchion mounting segment 86 and is also tangential to the outer circumferential surface of the stanchion mounting segment 86.

The upwardly sloped segments 83C, 83D provide clearance for the internal wheel assembly 61 and the extendable handle mechanism of the portable wardrobe bag 60, when the bottom support frame 80 is placed within the portable wardrobe bag 60. The two footing members 83 and 84 are connected at respective ends of the longitudinal horizontal segments 83A, 83B by connection 89.

The various "connection points" described herein may be implemented in various way in accordance with the embodiments. For example, tube cross connectors and tube tee-connectors may be used in some embodiments. In some embodiments, the bottom support frames are weldments and each of the connections is welded with the exception of the right angle connections which are formed by bending a single piece of tube. For example, the horizontal lower frame members 50, 51, 52 and 53 for the bottom support frame 40 may each be formed of a single piece having a right angle bend to form the respective long segments and short segments. In some embodiments, the horizontal lower frame member pair 50, 52 and horizontal lower frame member pair 51, 53 may be formed as a single piece. In other words, in one example, the horizontal lower frame member pair 50, 52 may be a single piece that is fit through a diametric bore through the first stanchion mounting segment 41, and subsequently welded into place.

In FIG. 6A and FIG. 6B, the connection points 87, 88, or 89 may be welds, or may be accomplished using tube connectors. The tangential connections to the outer circumferential surfaces of the stanchion mounting segments 85, 86 may be accomplished by welding, or by using tube crossover connectors. Various connection points described herein may also be implemented using tube connector nuts.

The various angled connections shown in FIG. 5C and FIG. 6C may be accomplished by bending a single tube to form the footing member 76 or the footing member 83. For example, angled connections 75A, 75H may be approximately 150° obtuse bends with respect to the primary longitudinal horizontal segment 75. Similarly, angled connections 83H, 83I may be approximately 150° obtuse bends with respect to the longitudinal horizontal segments 83A, 83B.

One disclosed example material in some embodiments is aluminum tubing as discussed above, however other materials may be used in accordance with the embodiments. For example, a light weight high strength carbon fiber material may be used in some embodiments. Alternatively, a plastic piping or tubing material may be used provided the materials has sufficient rigidity to avoid bending of the stanchions or the garment hanging rod.

The various embodiments have been described with respect to one type of portable wardrobe bag 60 however the embodiments are not so limited. Various types of bags may be used in accordance with the embodiments, such as suitcases, other types of duffel bags, etc. whether flexible or rigid, that are able to lay flatly any that can be opened to allow insertion of the various disclosed bottom support frames.

Additionally, various segments of the bottom support frame may be collapsible or telescoping such that the overall height, length or width may be adjusted to fit various sizes of bags or cases. For example, the connection points 87, 88 and 89 may be telescoping in some embodiments such that the bottom frame support 80 may be adjusted lengthwise. The telescoping segments may be locked into positions using various means such as, but not limited to, spring loaded dowel pins, cotter pins, etc.

It is to be understood that terms used herein such as "top," "bottom," "upper," "lower," "above," "below," "vertical," "horizontal," "coplanar," etc. are relative terms that are useful for describing the positions of the various structural members, within the various embodiments, relative to one another with respect to the structure as a whole, the structure as shown in the figures provided herein, and with respect to some point of reference, to facilitate understanding of the described positions and described structures. Therefore, it is also to be understood that such relative terms are for purposes of description only and are not to be construed as limiting terms and do not limit the scope of the embodiments herein described.

Therefore, various embodiments of a portable garment hanging system have been disclosed and described. Among the various features and advantages of a disclosed portable garment rack are light weight, easy and quick assembly and disassembly, and strength and stability. Although the use of the embodiments have no limitations, various attempts have been made to solve the problems of transporting a dance wardrobe to the performance or competition site and being able to quickly set up wardrobes for facilitating quick outfit changes. None of these attempts has provided the features and advantages of the presently disclosed embodiments which include a stable, lightweight, easy and quick to assemble portable garment rack. Thus, the presently disclosed embodiments fulfill a long felt need for features and advantages provide by the disclosed embodiments. Various other advantages may become apparent to those of ordinary skill and such other advantages are contemplated by, and in accordance with, the presently disclosed embodiments.

While various embodiments have been illustrated and described, it is to be understood that the invention is not so limited. Numerous modifications, changes, variations, substitutions and equivalents will occur to those skilled in the art without departing from the scope of the present invention as defined by the appended claims.

What is claimed is:

1. A portable garment rack, comprising:

a garment hanging rod, comprising a first hanging rod segment and a second hanging rod segment, the second hanging rod segment having an insertable segment, insertable into the first hanging rod segment to assemble the garment hanging rod, both the first and second hanging rod segments having perpendicular stub segments;

first and second stanchions, having upper insertable segments for insertion into the perpendicular stub segments to support the garment hanging rod, and lower insertable segments; and a bottom support frame, comprising two stanchion mounting segments, each fitted to receive the lower insertable segments of the respective first and second stanchions to support the first and second stanchions and the garment hanging rod, and two horizontal upper frame members, each coplanar and connected to the two stanchion mounting segments.

2. The portable garment rack of claim 1, the first and second stanchions each further comprising:

an upper support member having the upper insertable segment and an upper support member lower insertable segment; and a lower support member having the lower insertable segment and fitted to receive the upper support member lower insertable segment to assemble the respective stanchion.

3. The portable garment rack of claim 1, the bottom support frame further comprising:

two parallel footing segments, coplanar, positioned below the two horizontal upper frame members.

4. The portable garment rack of claim 3, the bottom support frame further comprising:

four vertical frame members, two vertical frame members connected to one of the two parallel footing segments and to one of the two horizontal upper frame members, and another two vertical frame members connected to the other of the two parallel footing segments and to the other of the two horizontal upper frame members.

5. The portable garment rack of claim 4, the bottom support frame further comprising:

four horizontal lower frame members, positioned coplanar below the two horizontal upper frame members and above the two parallel footing segments, two of the horizontal lower frame members each connected to one of the two stanchion mounting segments, and the other two of the horizontal lower frame members each connected to the other one of the two stanchion mounting segments.

6. The portable garment rack of claim 5, where each of the four horizontal lower frame members is connected to a respective one of the four vertical frame members.

7. The portable garment rack of claim 6, where the first hanging rod segment, the second hanging rod segment, the upper support members and lower support members of the first and second stanchions, are formed from aluminum tubing or a carbon fiber material.

8. The portable garment rack of claim 7, where the two parallel footing segments, the four vertical frame members, and the four horizontal lower frame members are formed from aluminum tubing or a carbon fiber material.

9. The portable garment rack of claim 7, where the aluminum tubing has at least a one inch outer diameter.

10. The portable garment rack of claim 8, where the first hanging rod segment, the second hanging rod segment, the upper support members and lower support members of the first and second stanchions, are formed from aluminum tubing with at least a one inch outer diameter; and where the two parallel footing segments, the four vertical frame members, and the four horizontal lower frame members are formed from aluminum tubing with at least a ¾ inch other diameter.

11. The portable garment rack of claim 10, where the two stanchion mounting segments are formed from aluminum tubing having the same outer diameter as the at least one inch outer diameter.

12. A portable garment hanging system comprising the portable garment rack of claim 1, and a portable wardrobe bag having a main inner compartment, the bottom support frame fitting within the main inner compartment, and the garment hanging rod and first and second stanchions fitting within the main inner compartment for storage when dissembled.

13. The portable garment hanging system of claim 12, where the main inner compartment comprises a wheel assembly that protrudes into the main inner compartment wherein the bottom support frame provides clearance for the wheel assembly.

* * * * *